United States Patent [19]

Norman

[11] Patent Number: 4,825,892

[45] Date of Patent: May 2, 1989

[54] INSTANTLY STABLE, QUICKLY ERECTABLE AND QUICKLY COLLAPSIBLE PORTABLE STRUCTURE

[75] Inventor: Lowell R. Norman, Montrose, Calif.

[73] Assignee: Pure Concepts, Inc., La Canada, Calif.

[21] Appl. No.: 162,281

[22] Filed: Feb. 29, 1988

[51] Int. Cl.[4] ..... E04H 15/40; E04H 15/38; E04H 15/44; E04H 15/32

[52] U.S. Cl. ..... 135/104; 135/103; 135/106; 135/905

[58] Field of Search ..... 135/104, 103, 106, 97, 135/905

[56] References Cited

U.S. PATENT DOCUMENTS

| | | | |
|---|---|---|---|
| 1,352,032 | 9/1920 | Sherman | 403/306 |
| 2,434,251 | 1/1948 | Warnke | 403/393 X |
| 3,675,667 | 7/1972 | Miller | 135/104 |
| 3,699,986 | 10/1972 | Kirkham | 135/119 X |
| 3,960,161 | 6/1976 | Norman | 135/104 |
| 3,965,915 | 6/1976 | Kirkham | 135/97 |
| 3,990,463 | 11/1976 | Norman | 135/104 |
| 4,195,651 | 4/1980 | Watts et al. | 135/102 |
| 4,269,210 | 5/1981 | Marks | 135/104 |

*Primary Examiner*—J. Karl Bell
*Attorney, Agent, or Firm*—F. Eugene Logan

[57] ABSTRACT

A portable structure that, without disassembly or separation of its basic parts, can be rapidly transformed between its fully erected configuration and its fully collapsed configuration by one individual unaided by another person. The structure, in its collapsed configuration, can be easily carried by one individual. In its expanded configuration the structure is instantly stable when placed on the ground. In one embodiment the structure serves as a light weight beach cabana that can be easily carried by a child. The basic portable structure does not require separation and reassembly of its components at any time before, during or after transformation from the collapsed or expanded configuration.

20 Claims, 15 Drawing Sheets

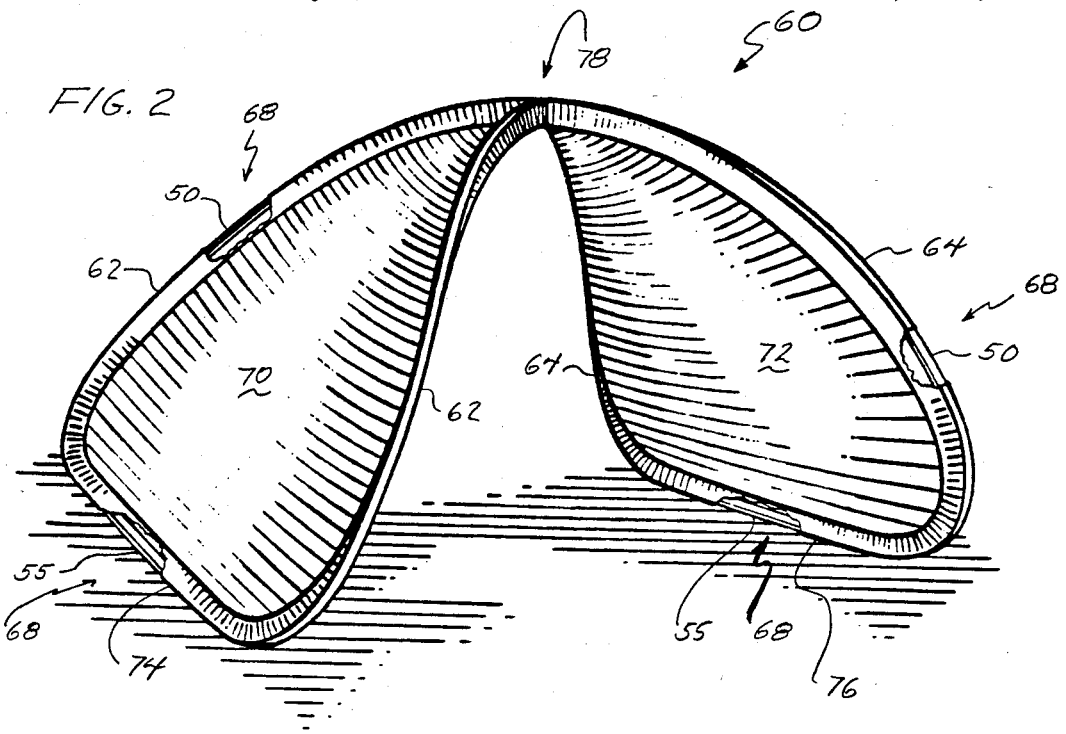
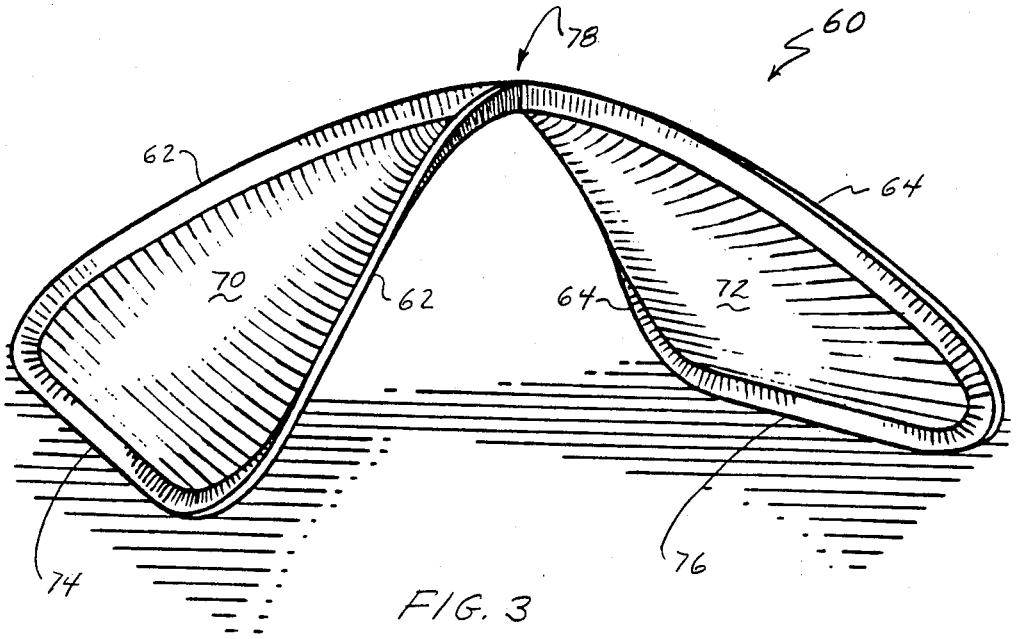
FIG. 3

FIG. 4
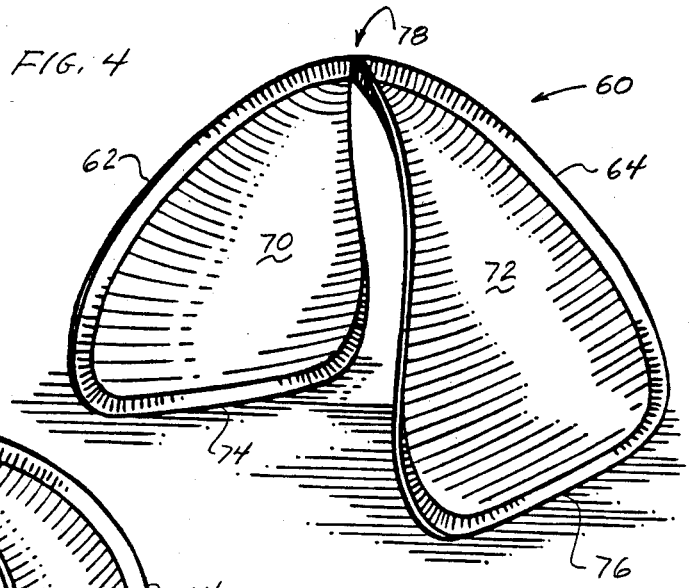
FIG. 5
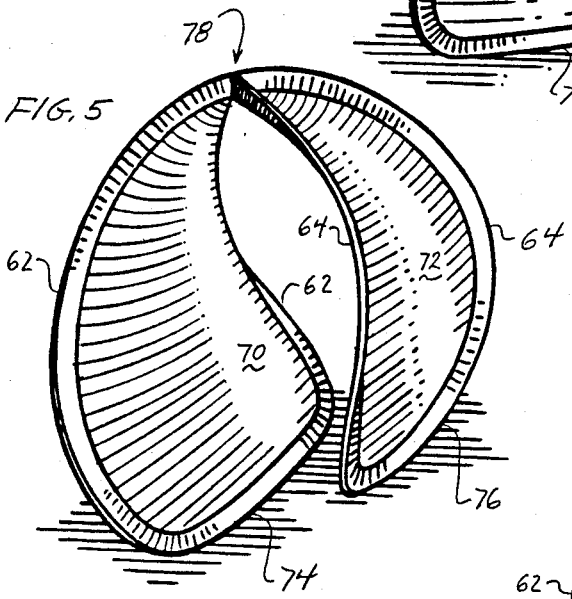
FIG. 6
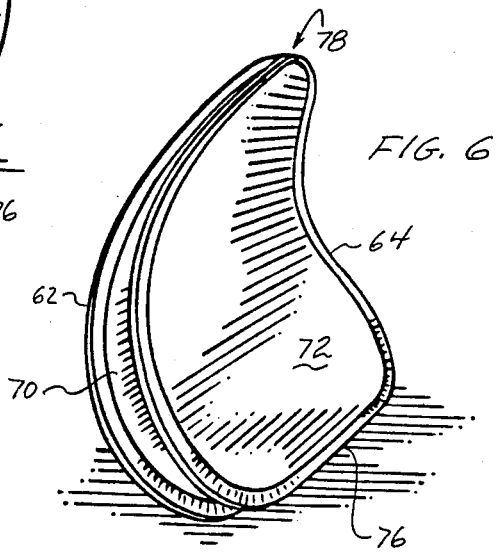
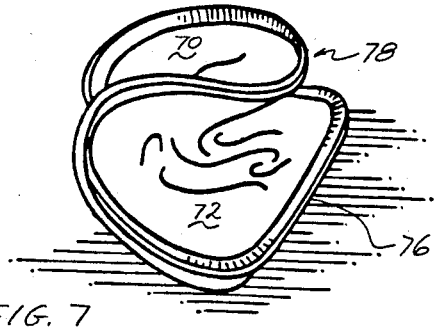
FIG. 7
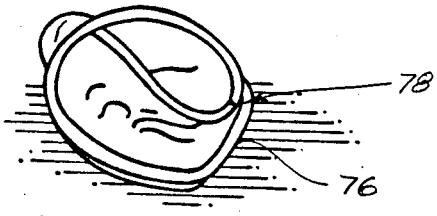
FIG. 8

FIG. 9
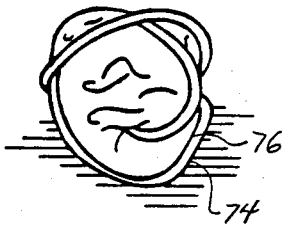
FIG. 10
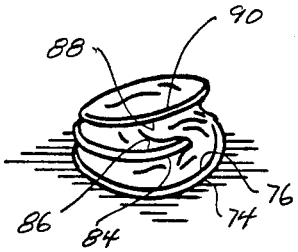
FIG. 11
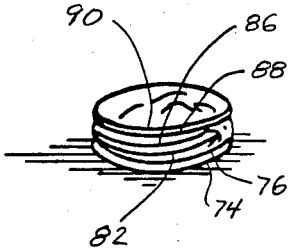
FIG. 12
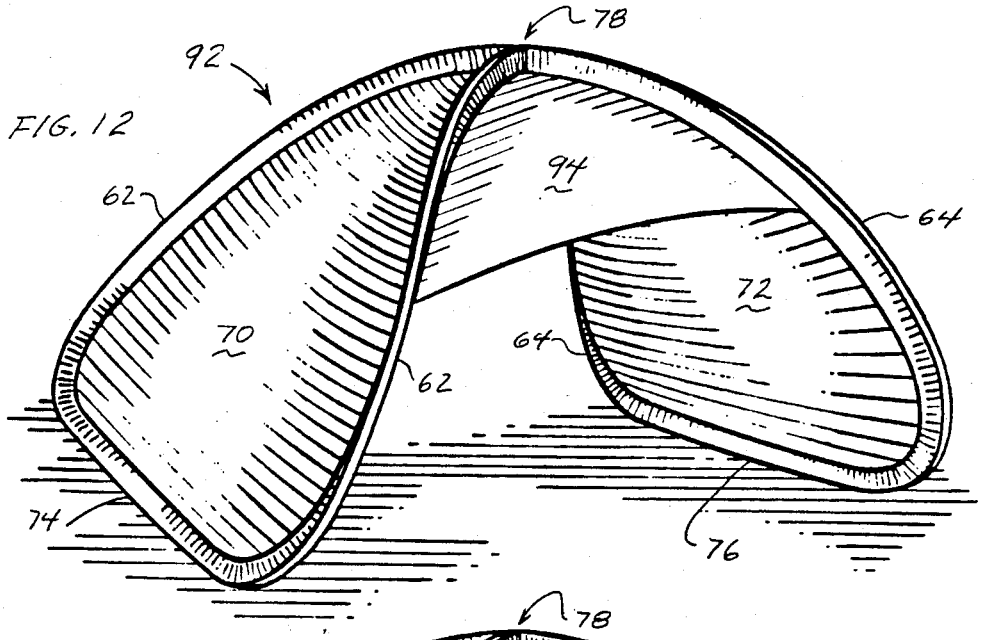
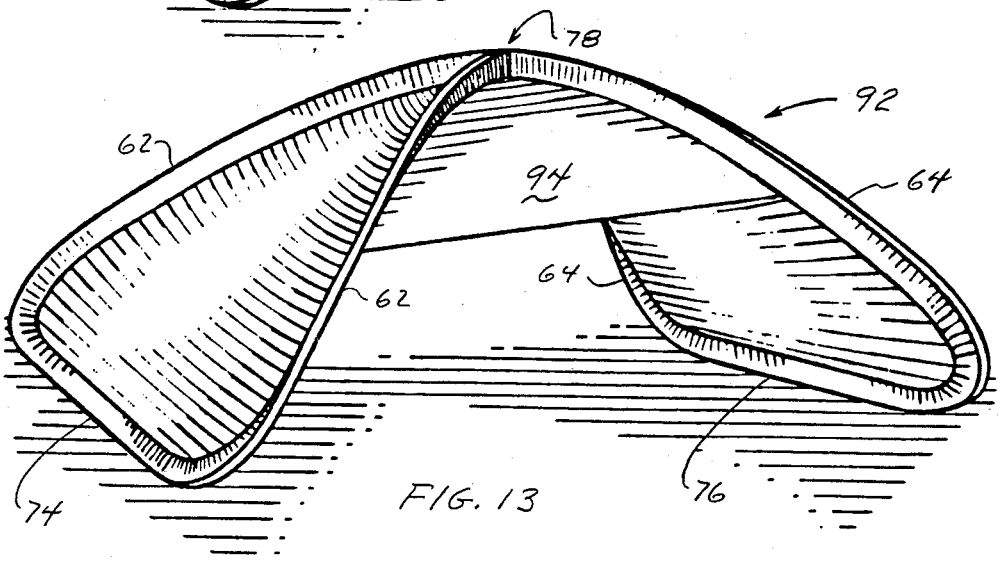
FIG. 13

FIG. 30
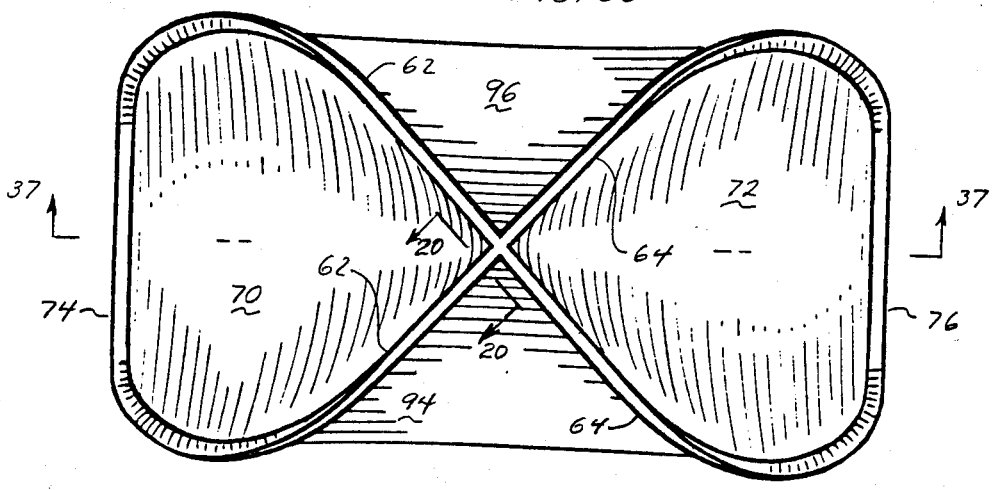
FIG. 31
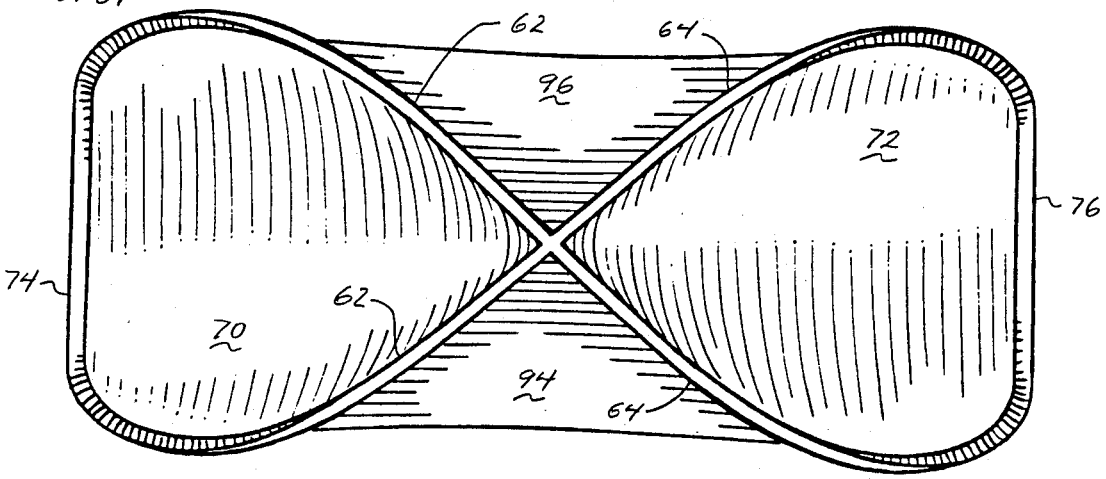
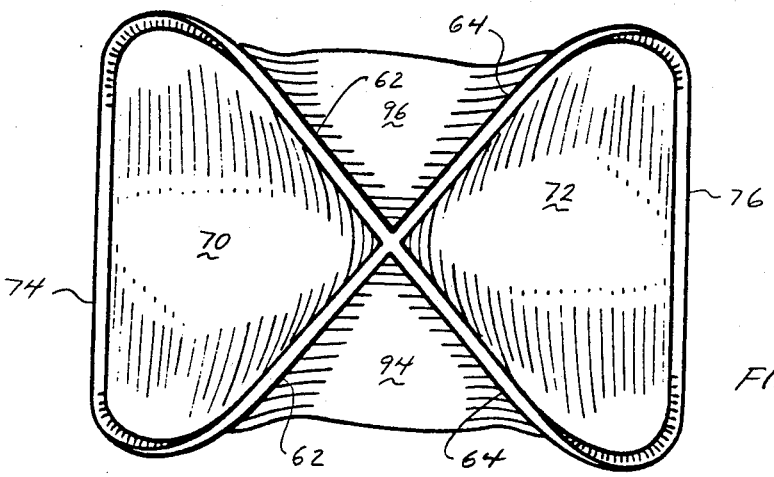
FIG. 32

FIG. 41
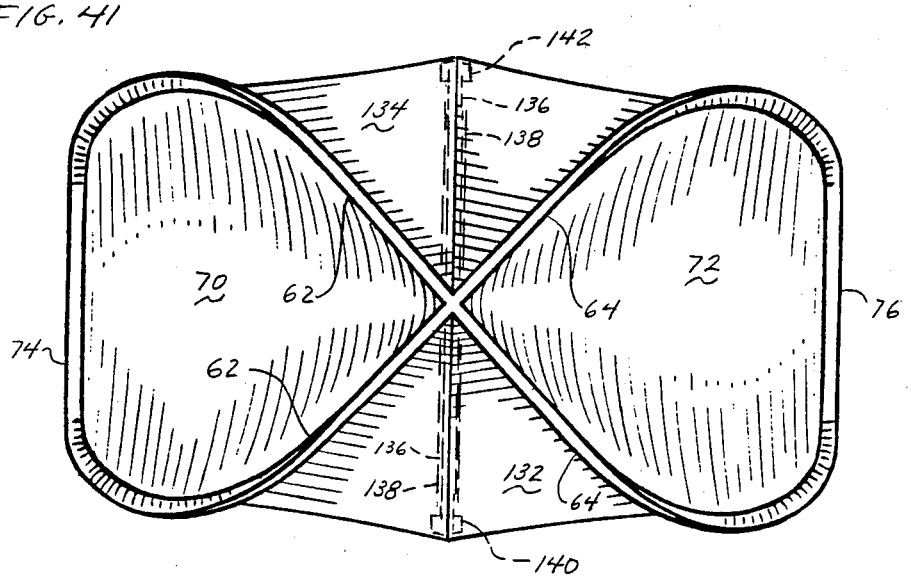
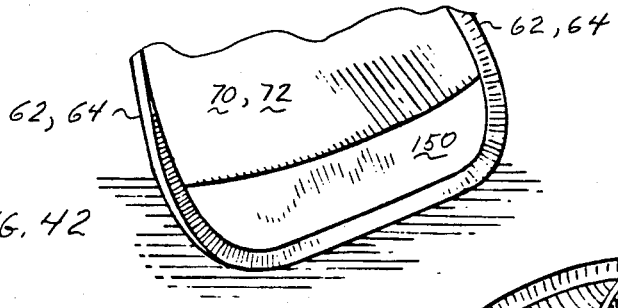
FIG. 42
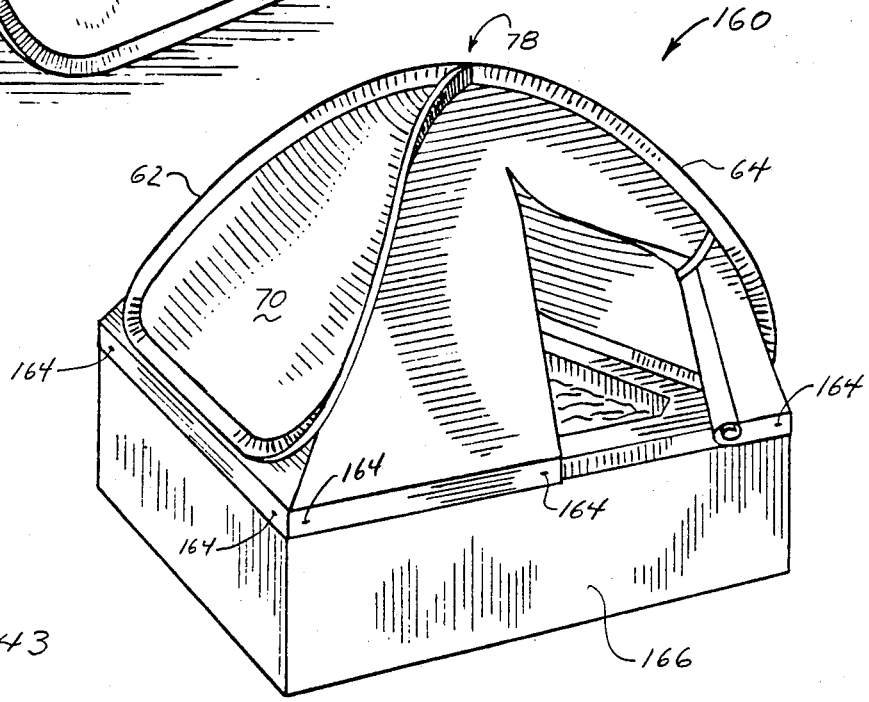
FIG. 43

FIG 44
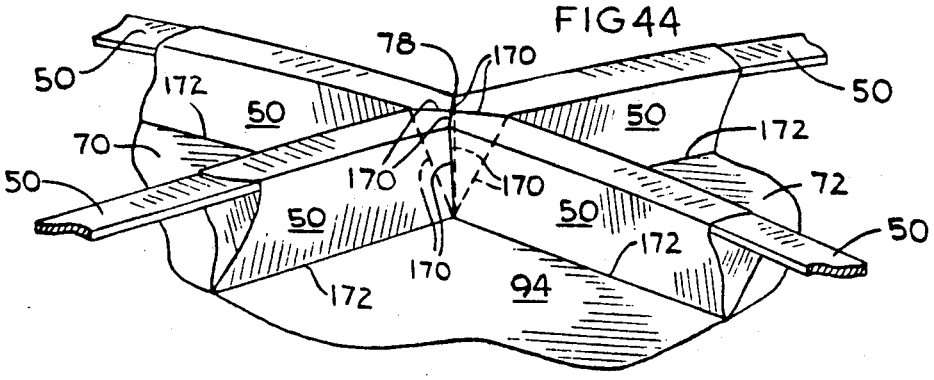
FIG 45
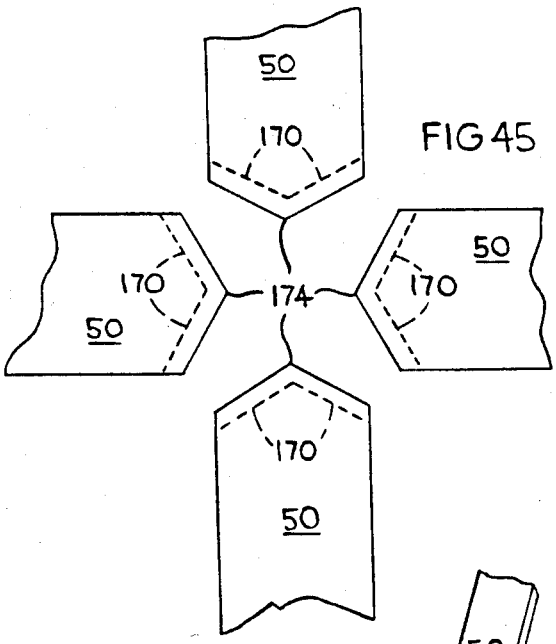
FIG 46
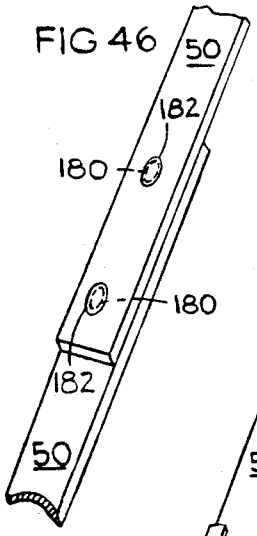
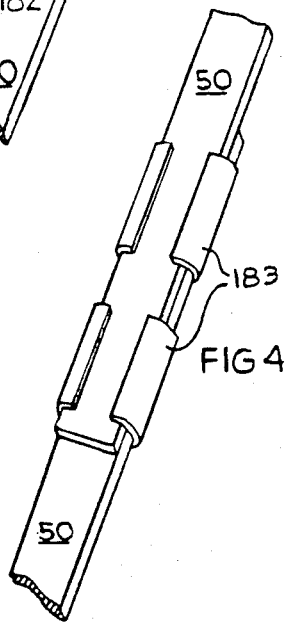
FIG 47
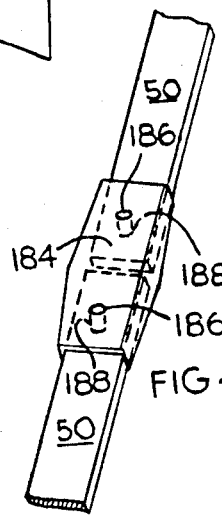
FIG 48

INSTANTLY STABLE, QUICKLY ERECTABLE AND QUICKLY COLLAPSIBLE PORTABLE STRUCTURE

TECHNICAL FIELD

This invention relates generally to structures and particularly portable structures that can be rapidly transformed between a fully erected and fully collapsed configuration.

BACKGROUND OF THE INVENTION

The origins of the technology relating to portable structures such as tents is lost in antiquity. However, despite the unascertainable interval of time during which this technology has evolved and advanced, new and improved structures particularly adapted for such use continue to be developed. For example, U.S. Pat. No. 3,900,463 issued to L.R. Norman on Nov. 9, 1976 discloses such a structure useful as a tent which can be best be described as self-erecting. Said U.S. Pat. No. 3,990,463 is hereby incorporated herein by reference.

The structure disclosed in that patent consists of a fabric shell which forms the various outer surfaces of the erected structure and a frame for supporting such fabric when the structure is erected. In particular, the frame disclosed in that patent consists of a single loop of flexible, coilable, resilient material secured along its length into the structure's fabric so as to assume a bowed and rounded figure-eight configuration when the structure is erected. Specifically in that structure, the midpoint of this figure-eight shaped frame is located at the structure's apex with the two rounded loops of the frame's figure-eight shape confronting the surface upon which the structure rests. The support which this frame provides the erected structure is substantially increased by compressive forces applied to the frame by the tensioned fabric of its body.

Although the structure of the patent is quite useful, during erection the structure has a tendency to roll from front to back and from side to side thereby making complete erection to a stable tent difficult and especially difficult if attempted by just one person without the assistance of another person to prevent the rolling back and forth. As the patent teaches, the structure is finally stabilized by driving four stakes through the stake loops contained on the four corners of the structure. After securing the four stake loops to the ground with stakes the structure is stabilized and ready for use. What is needed, therefore, is a structure that can be readily transformed to its expanded configuration and upon such expansion be in a stabilized configuration so that the structure can be fully and easily erected by one person.

It is also desirable to have a basic structure which is lightweight and can be carried by one person to the beach to use as a cabana for shade from the sun which does not require the use of stakes or the like to extend the structure to its fully deployed configuration so that there is no need to worry about the loss of such stakes or other tie down devices while at the beach or when leaving the beach.

SUMMARY OF THE INVENTION

An object of the present invention is to provide an improved, portable structure which can be easily transformed between a fully expanded and a fully collapsed configuration.

Another object is to provide an improved, portable structure which when transformed to a fully expanded or erected configuration is immediately in a stable configuration.

Another objective is to provide a portable structure which is lightweight and can be easily carried for long distances by and erected by one person.

Another objective is to provide a portable structure which does not require stake loops and stakes and similar devices to be stable when in its fully expanded configuration.

Accordingly, there is provided by the principles of this invention, a portable structure operable for transforming from a collapsible configuration into an expanded configuration and thence back into the collapsible configuration comprising a frame formed from a flexible coilable material, the frame having, when in an expanded configuration, a shape of a figure eight thereby defining first and second loops and a crossover with the crossover forming an apex of the structure and the loops thereof extending downwardly therefrom, and first and second side panels formed from a foldable cloth-like material, the first and second side panels spanning the first and second loops, respectively, of the frame and connected thereto. The first and second side panels each having a straight portion opposite the crossover, and the straight portion of the panels is operative for forming when the portable structure is in the expanded configuration, a corresponding stable straight portion in each of the loops of the frame opposite the crossover. The corresponding stable straight portion of the loops are operable, when the structure is in the expanded configuration with the straight portion of the loops placed on top of a flat surface, for preventing the structure from rolling over and for maintaining the crossover at the apex of the structure. The structure, when in the expanded configuration, also is operable for transforming by collapsing into a collapsible configuration without separation of the frame from the side panels, the collapsible configuration comprising six overlying loops of the frame. The structure, when in the collapsible configuration, also is operable for transforming into the expandable configuration without separation of the frame from the side panels merely by spreading such six overlying loops of the frame apart and allowing the frame to spring into the expanded configuration, which is instantly stable when the straight portions thereof are placed on a flat surface.

In one embodiment of this invention, the frame is a continuous piece of the flexible coilable material.

In another embodiment of this invention, the straight portion of at least one of the loops is between about 10 and about 40% of the periphery of the loop. In a further embodiment, the straight portion of at least one of the loops is between about 20 and about 30% of the periphery of the loop.

In yet another embodiment of this invention, the flexible coilable material of the frame has a predetermined amount of original curvature operable for effecting a predetermined height for the structure when in the expanded configuration with the straight portions of the loops placed on top of a flat surface, the predetermined height being defined as the vertical distance from the flat surface to the crossover of the structure.

In still another embodiment of this invention, the flexible coilable material of the frame has a cross section having a width and a thickness and the width is at least about two times larger than the thickness.

In another embodiment of this invention, the flexible coilable material of the frame contains one 360° twist.

In yet another embodiment of this invention, the flexible coilable material of the frame has an upper surface and a lower surface which define a maximum thickness therebetween and a first side surface and a second side surface which define a maximum width therebetween, and the maximum width thereof is at least about two times larger than the maximum thickness thereof, and preferably at least about four times larger. Furthermore, the flexible coilable material of the frame contains one 360° twist. At the crossover thereof, there is an upper portion of the frame on top of a lower portion of the frame and the lower surface of the upper portion of the frame lays over top and faces the upper surface of the lower portion of the frame.

In still another embodiment of this invention, the first and second side panels are connected to the first and second loops, respectively, of the frame by first and second elongated pockets, respectively, and the first and second elongated pockets are permanently attached to the first and second side panels, respectively. Furthermore, the first and second loops of the frame are slideably enclosed in the first and second elongated pockets, respectively, and when the portable structure is in the expanded configuration, the elongated pockets extend upwardly and outwardly from the side panels at the crossover.

In another embodiment of this invention, the portable structure further comprises a floor panel formed from a foldable cloth-like material, and the floor panel spans between the straight portion of the first loop and the straight portion of the second loop.

In yet another embodiment of this invention, the portable structure further comprises front and rear panels formed from a foldable cloth-like material, and the front and rear panels span at least a portion of front and rear spaces, respectively, between the side panels, and the front and rear panels are connected to front and rear parts, respectively, of the side panels. In a still further embodiment, the front and rear panels are connected to the side panels proximate the crossover and extend downwardly therefrom and proximate the frame a distance of at least about ¼ of a distance between the crossover of the frame and an horizontally projected extension, respectively, of the straight portion of the frame. In yet a further embodiment, the rear panel extends downwardly from the crossover a greater distance than the front panel extends downwardly from the crossover.

In another embodiment of the portable structure of this invention, the front and rear panels are connected to the side panels proximate the crossover of the frame and extend downwardly therefrom, when the structure is in its expanded configuration, to the straight portion of the loops, and the front panel has an opening for entry into the structure. In a further embodiment, the front and rear panels each have a bottom edge, and the structure further comprises a floor panel formed from a foldable cloth-like material, and the floor panel spans between the straight portion of the first loop and the straight portion of the second loop, and the floor panel is connected to the bottom edge of the front and rear panels.

In yet another embodiment of this invention, the front and rear panels each have a lower edge, and the portable structure further comprises a tension means for tensioning the lower edge of the front panel from the lower edge of the rear panel.

In still another embodiment of this invention, the portable structure further comprises side pockets attached to the outside surface of each of the side panels, respectively, proximate the straight portion of the frame, and each of the side pockets has an upwardly facing pocket opening when the structure is in the expanded configuration with the straight portion of the loops placed on top of a flat surface.

In general, the frame is formed from a length of material which is relatively strong and yet flexible to a sufficient degree to allow it to be coilable. Further, the frame material should be resilient and is preferably anisotropic; e.g. by being asymmetric abou its longitudinal axis. In one embodiment of this invention, the material for the frame member is flat spring steel stock and preferably stainless steel for its corrosion resistance although plated or coated spring steel stock can be used instead. Other materials which may be employed to form the frame include plastic materials having relatively high bending moduli which are in the shape of a flat strip or an oval shaped tube. Round or square shaped tubing or solid stock can also be employed as material for forming the frame. For a portable structure having an approximate width across its base of about 5 feet, a height of about 4 feet, and a length of about 4 feet, the preferred material for the frame is a flat spring steel stock having a thickness of approximately 1.25 millimeters (0.050 inch) and a width of approximately 12.5 millimeters (0.500 inch). The frame is preferably formed with a single 360° twist, particularly when it is formed from a flat stock. Thus, in joining the ends of a length of such material to form the frame, the ends of the material are first brought together as if to form a simple, untwisted loop. One end is than rotated 360° relative to the other end about the longitudinal axis of the strip. Finally, the ends can be secured together by overlapping them and fastening a rivet through them.

The portable structure includes a loop compression means formed by panels. In general, side panels are secured to elongated pockets along their periphery to respectively span each loop of the figure-eight shaped frame.

For example, in one embodiment, the figure-eight shaped frame of the portable structure of the present invention is enclosed within and secured to the remainder of the structure's foldable cloth-like material by elongated, tubularly shaped pockets which project outwardly from the structure's foldable cloth-like body or panel members. Thus, when the structure is erected, the elongated pockets containing the frame extends outwardly from the structure's panel members.

The preferred foldable cloth-like materials from which the panels of the portable structure of this invention are formed including the elongated pockets are those commonly used in fabricating tents and other portable structures. Strong, lightweight materials such as those made from fibers produced by E.I. Du Pont de Nemours and sold under the trademarks Nylon and Dacron are particularly preferred.

BRIEF DESCRIPTION OF THE DRAWINGS

FIG. 2 is a perspective view of the basic embodiment of this invention for a portable structure shown in an expanded configuration with the straight portions of the frame, or base, spread an average distance apart.

FIG. 3 is another perspective view of the structure of FIG. 2 with the straight portions of the frame spread a relatively large distance apart thereby providing a relatively large width to the structure.

FIG. 4 is another perspective view of the structure of FIG. 2 with straight portions of the frame spread a relatively small distance apart thereby providing a relatively large height to the structure.

FIGS. 5 to 11 are perspective views depicting the transformation of the structure of FIG. 2 in various stages from its expanded configuration as shown in FIGS. 2 to 4 to a completely collapsed configuration as shown in FIG. 11.

FIG. 12 is a perspective view of another embodiment of the portable structure of this invention with small front and rear panels and straight portions of the frame spread an average distance apart.

FIGS. 13 and 14 are perspective views of the structure of FIG. 12 with straight portions of the frame spread a relatively large distance apart as in FIG. 13 and a relatively small distance apart as in FIG. 14.

FIG. 30 is a top plan view of the structure of FIG. 12.

FIG. 31 is a top plan view of the structure of FIG. 13.

FIG. 32 is a top plan view of the structure of FIG. 14.

FIG. 41 is a top plan view of the structure of FIG. 38.

FIG. 42 is a perspective view of a detail of a side panel having a side pocket.

FIG. 43 is a perspective view of another embodiment of this invention useful for covering a spa.

FIG. 44 is a partially sectioned diagrammatic perspective of the crossover of FIG. 12 depicting the elongated pockets enclosing the crossover point of the figure-eight shaped frame about the structure's apex.

FIG. 45 is a diagrammatic plan view of the panel material formed into that portion of the elongated pockets which encloses the crossover point of the figure-eight shaped frame before that material is sewn together thus forming the frame enclosing pockets.

FIG. 46 is a diagrammatic perspective view depicting a method of riveting together the ends of the length of material to form the structure's continuous figure-eight shaped frame.

FIG. 47 is a diagrammatic perspective view depicting another method of securing together the ends of the length of material making up the structure's figure-eight shaped frame by swaged clamping.

FIG. 48 is a diagrammatic perspective view depicting yet another method of securing together the ends of the length of material making up the structure's figure-eight shaped frame with a molded clamp.

DESCRIPTION OF THE PREFERRED EMBODIMENTS

Figure 1:
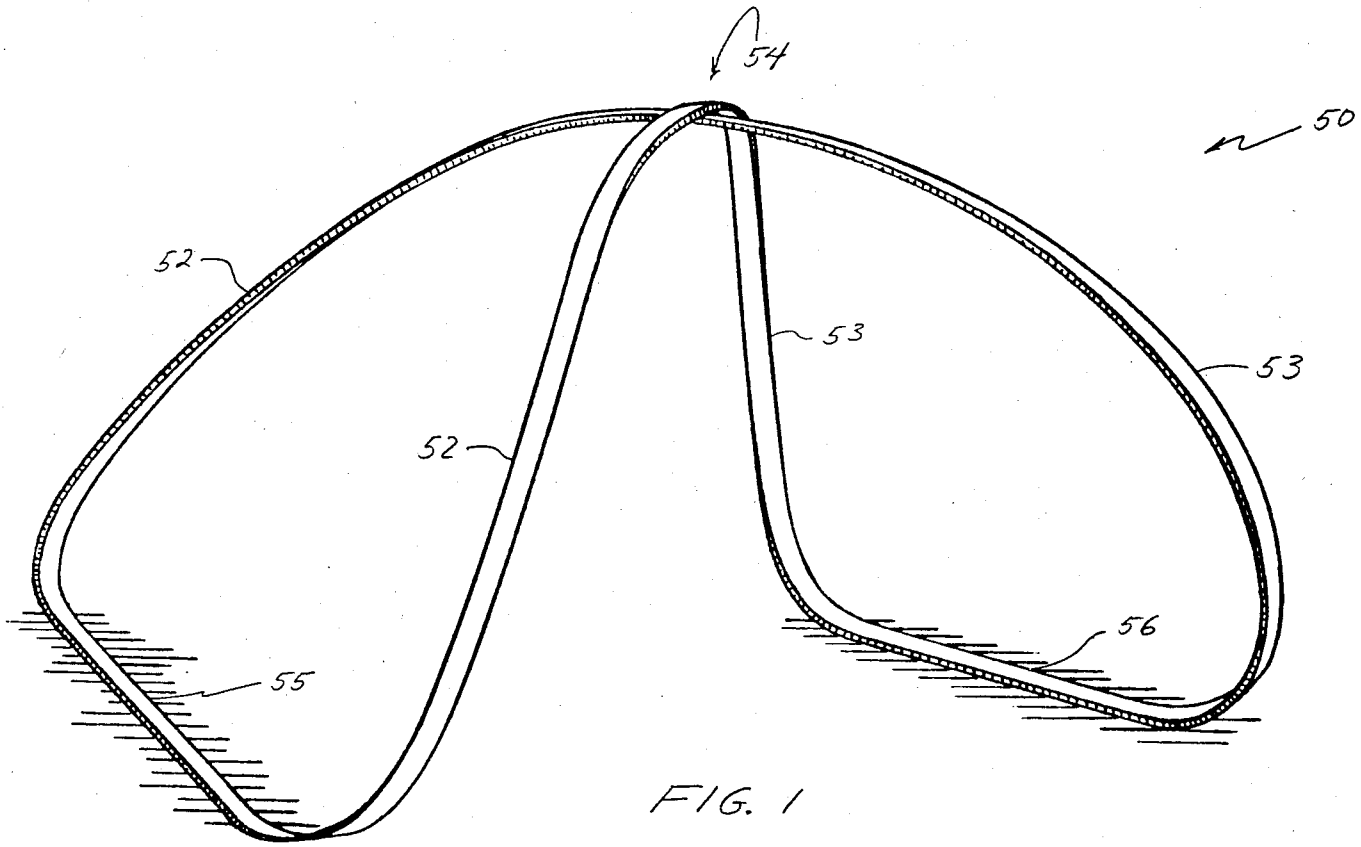
FIG. 1 is a perspective view of the basic frame member of this invention with side panels not shown thereby more clearly showing the figure eight character of the frame when in the structure and the frame's "continuous" character.

FIG. 1 is a perspective view of one embodiment of frame member 50 of this invention showing the frame as it would exist in an expanded configuration with side panels (the side panels are not shown so that the form of the frame can be more easily shown) wherein the figure eight construction is characterized by left loop 52 separated from right loop 53 by crossover point 54. It is to be noted that the overlying parts of the frame are not required to be pinned or hinged together at the crossover. Left and right loops 52 and 53 contain when in the portable structure straight portions 55 and 56, respectively, for resting on flat surface 58 when the structure is in the expanded configuration. Frame 50 is preferably formed from spring steel stock having a rectangular cross section with the widest surfaces thereof facing each other at crossover point 54. Straight portions 55 and 56 are long enough that the portable structure when in its expanded configuration will be stable when placed on a flat surface with the crossover at the apex of the portable structure as will be more fully explained. In one embodiment straight portions 55 and 56 are between about 10 and about 40% of the periphery of loops 52 and 53 respectively. In a preferred embodiment straight portions 55 and 56 are between about 20 and about 30% of the periphery of loops 52 and 53, respectively. Straight portions 55 and 56 are operable when the portable structure is in its expanded configuration and placed on a flat surface to prevent the portable structure from rolling over. In other words, the portable structure is instantly stable when in its expanded configuration as will be explained.

In a preferred embodiment, frame member 50 contains one 360° twist. For example, if a strip of rectangular spring steel stock is bent around so that the ends of the stock face each other, one end is then rotated 360° relative to the other end and the ends then fasten together by welding, riveting, bolting, by strapping together, or any other method of joining the ends together thereby forming a frame which is "continuous." In one embodiment, the frame except for straight portions 55 and 56 has a predetermined amount of original curvature which is operable for effecting a predetermined height for the frame when it is in its expanded configuration. The frame of FIG. 1 can be fitted with panels in a variety of ways as will be explained next.

FIG. 2 shows a preferred embodiment of basic portable structure 60 of this invention it its expanded configuration, which comprises left side and right side elongated pockets or sleeves 62 and 64 which contain frame 50 formed from a flexible coilable material as shown in cut-away details 68.

Side panels 70 and 72 are permanently attached to elongated pockets 62 and 64, respectively. Elongated pockets 62 and 64 and side panels 70 and 72 contain straight portions 74 and 76 which produce the straight portions 55 and 56 of frame 50 in the portable structure, and crossover point 78 at the apex of the expanded configuration of structure 60 which corresponds to crossover point 54 of frame 50. Frame 50 is slideable in pockets 62 and 64.

Figure 19:
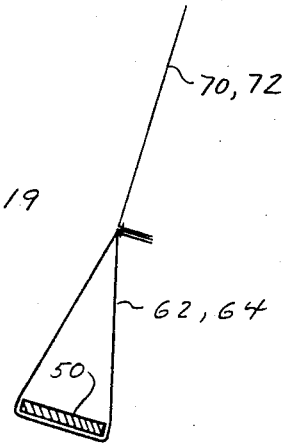
FIG. 19 is an enlarged detail in cross section taken in the direction of lines 19—19 of FIG. 21 showing the frame in an elongated pocket which is attached to a side panel.
Figure 20:
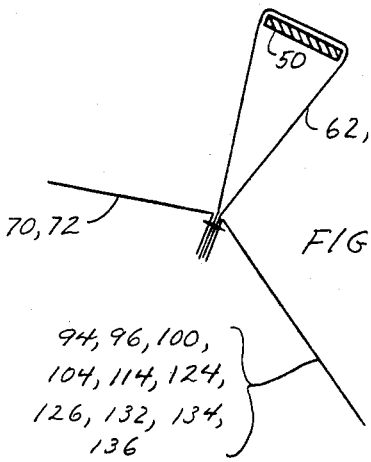
FIG. 20 is an enlarged detail in cross section taken in the direction of lines 20—20 of FIG. 30 showing the joining of a side panel and front or rear panel to an elongated pocket for the frame.

The frame is designed to stretch the panels to a taut condition and as a consequence at crossover 78, elongated pockets 62 and 64 assume a more perpendicular orientation relative to side panels 70 and 72, whereas at straight portions 74 and 76, the pockets assume a parallel orientation relative to side panels 74 and 76, see FIGS. 19 and 20.

Elongated pocket straight portions 74 and 76 and corresponding produced straight portion 55 and 56 of the frame are long enough that the structure when in its expanded configuration will be instantly stable when placed on a flat surface with the crossover thereof at the apex of the structure. In one embodiment the straight portions of structure 60 are between about 10 and about 40% of the periphery of the loops. In a preferred embodiment, the straight portions are between about 20 and about 30% of the periphery of the loops. In any event, the straight portions are operable that when structure 60 in its expanded configuration is placed on a flat surface, the structure will not roll over. The stability of the basic structure in its expanded configuration does not require front or rear panels, or a floor panel, or tie down means to prevent the structure from rolling over. The structure is therefore instantly stable as soon as expanded. Furthermore, structure 60 can be transformed into a collapsible configuration without separation of the frame from the elongated pockets and side panels. Heretofore it was not thought that a transformable structure could be produced which would not require for stability either front and rear panels, or a floor panel, or tie downs, or a combination of such additional features. However in this invention, the portable structure is stable in its expanded configuration without front or rear panels, or a floor panel, or both and can be transformed into a collapsible configuration without removal of any portion of the frame member from the side panels. The structure of this invention can be transformed between its expanded and collapsible configurations without unsnapping snaps, unhooking hooks, or untying strings or ropes, or similar means and will remain permanently stable in its expanded configuration without the necessity of tie downs, stakes, weights or the like as soon as it is expanded.

Furthermore, structure 60 can assume an infinite variety of height to width ratios as shown in FIGS. 2 to 4 in which structure 60 has a different spreading apart of straight portions 74 and 76, for example, an average spread as shown in FIG. 2, or a wide spread with low height as shown in FIG. 3, or a narrow spread with high height as shown in FIG. 4.

The ease of transforming the structure from its expanded configuration to its fully collapsed configuration is shown by various stages of transition depicted in FIGS. 5 to 11. In FIG. 5, straight portions 76 and 78 of the frame are deformed towards each other. In FIG. 6, the two large loops are deformed so that they overlie each other and crossover 78 is partly bent towards straight portion 76 of structure 60. In FIG. 7, crossover 78 is further bent towards straight portion 76 until the structure assumes the character of a pair of overlying saddles. In FIG. 8, crossover 78 is rotated relative to straight portion 76 thereby causing the structure to further collapse. In FIG. 9, the collapsed frame assumes an overlying six small loop configuration which is readily squeezed together as shown in FIG. 11 to the fully collapsed configuration. As the transformation proceeds in stages shown in FIGS. 10 and 11, straight portions 74 and 76 begin to bend and take on a more circular shape due to the flexibility of the frame material. As shown in FIGS. 10 and 11, six small overlying loops are formed by the deformed frame as designated by elements 80, 82, 84, 86, 88 and 90. Consequently, the fully collapsed structure is like six looped rings with the six small loops lying on top of each other with the panel material wadded in between the six loops.

The fully collapsed structure can be transformed to the expanded configuration merely by pulling the six small rings apart and allowing them to spring into the figure eight expanded configuration.

Figure 14:
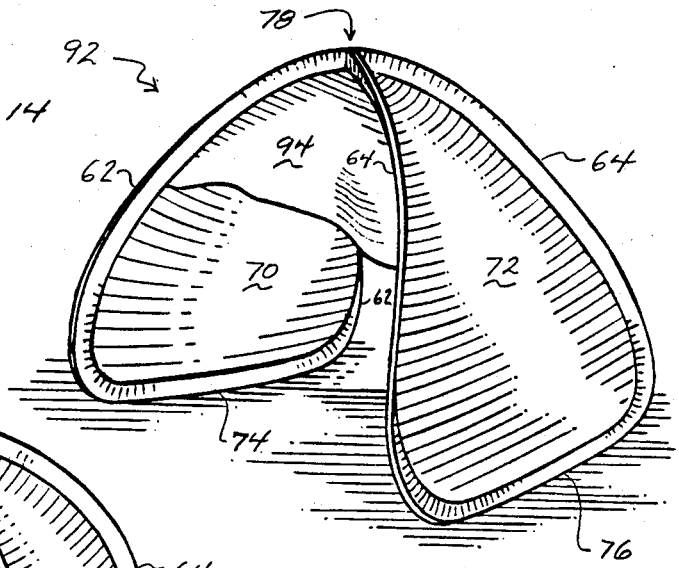

FIG. 12 is another embodiment of this invention in which portable structure 92 has the same basic figure eight structure as in structure 60 of FIG. 2 but also having small front and rear panels 94 and 96, respectively, for providing extra shade area from the sun. Rear panel 96 is identical to front panel 94 and can be formed from the same material as side panels 62 and 64. Elements having the same element number on the various embodiments of this invention indicate that the elements are essentially identical. As with structure 60 of FIG. 2, structure 92 can assume an infinite variety of height to width ratios as shown in FIG. 12 in which structure 60 has an average spreading apart of straight portions 74 and 76, or FIG. 13 having a wide spreading apart of straight portions 74 and 76 with a low apex height, or in FIG. 14 having a narrow spreading apart of straight portions 74 and 76 with a relatively high apex height. The infinite variety of height to width ratios makes the portable structure of this invention useful both for lying under as on a beach towel and sitting under as in a chair.

Figure 15:
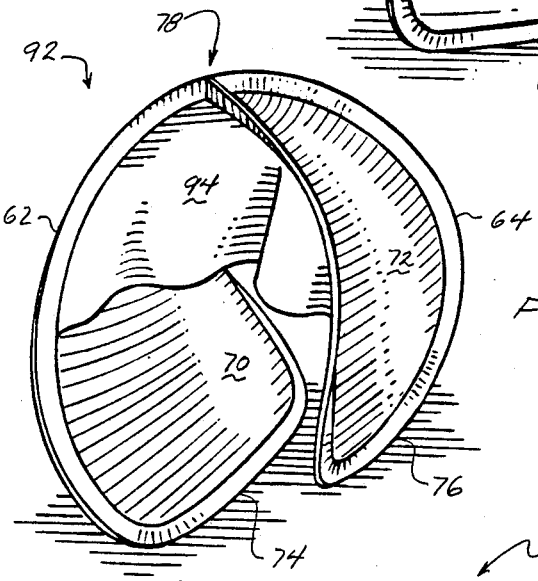
FIG. 15 is a perspective view depicting an early stage in the transformation of the structure of FIG. 12 from its expanded configuration and is similar to FIG. 5. Since the front and back panels of the structure of FIG. 12 are tucked into the structure subsequent stages of the transformation operation would have the same appearance as FIGS. 6 to 11.

Structure 92 of FIG. 12 can be transformed from the expanded configuration to the fully collapsed configuration in the same manner as structure 60 of FIG. 2. FIG. 15 shows structure 92 being collapsed to the same degree as that of FIG. 5 for the structure of FIG. 2. Since the front and rear panels 94 and 96 of structure 92 of FIG. 12 are tucked into the frame during the transformation to the collapsed configuration, the various stages of transformation to the fully collapsed configuration would appear if shown similar to those shown in FIGS. 6 to 11 of structure 60 with only a minor difference to FIG. 6 in which a portion of the front panel 94 could still be seen between the front part of pockets 62 and 64. Rear panel 96 is hid from view but can be seen in FIGS. 21 to 23 which will be discussed later.

Figure 16:
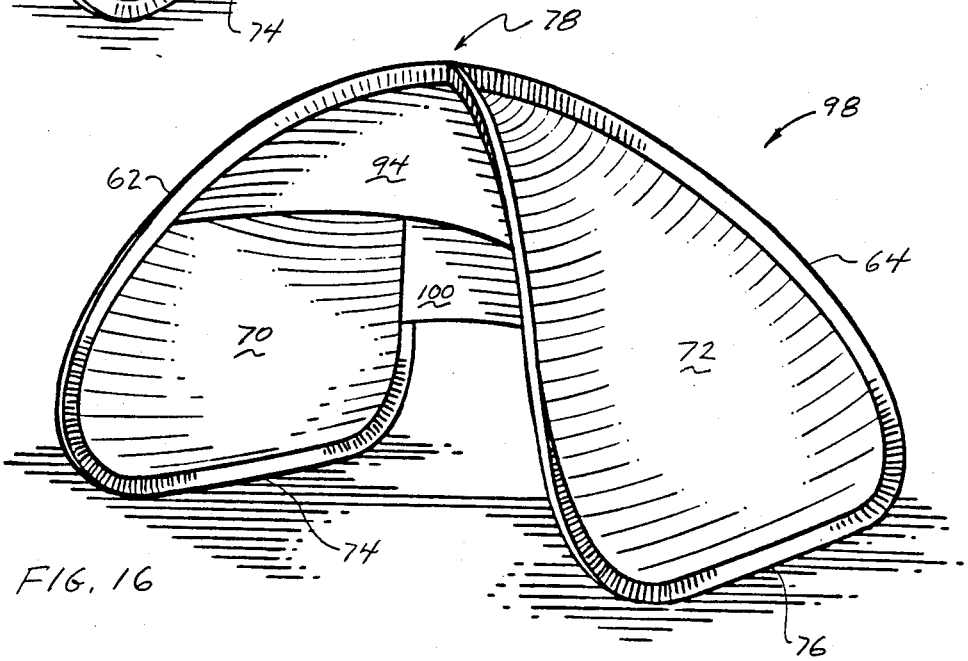
FIG. 16 is a perspective view depicting another embodiment of this invention in an expanded configuration with a larger and longer rear panel than a front panel.

FIG. 16 depicts another embodiment 98 of this invention similar to that of FIG. 12 but with a longer rear panel 100 than rear panel 96 of structure 92.

Figure 17:
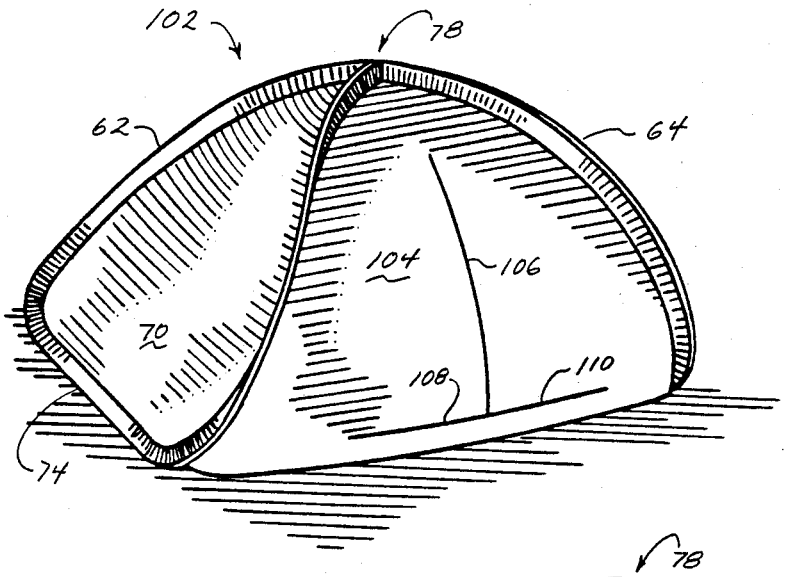
FIG. 17 is a perspective view depicting another embodiment of this invention in an expanded configuration with a full front panel with a zipper opening for entry into the structure, the structure having a full rear panel similar to the front panel but without the opening.

FIG. 17 depicts yet another embodiment of this invention with general structure 102 having a full front panel 104 and zippers 106, 108 and 110 which provide for entry into the structure. This embodiment has a full rear panel (not shown) which is similar to front panel 104 but without zippers for entry.

Figure 18:
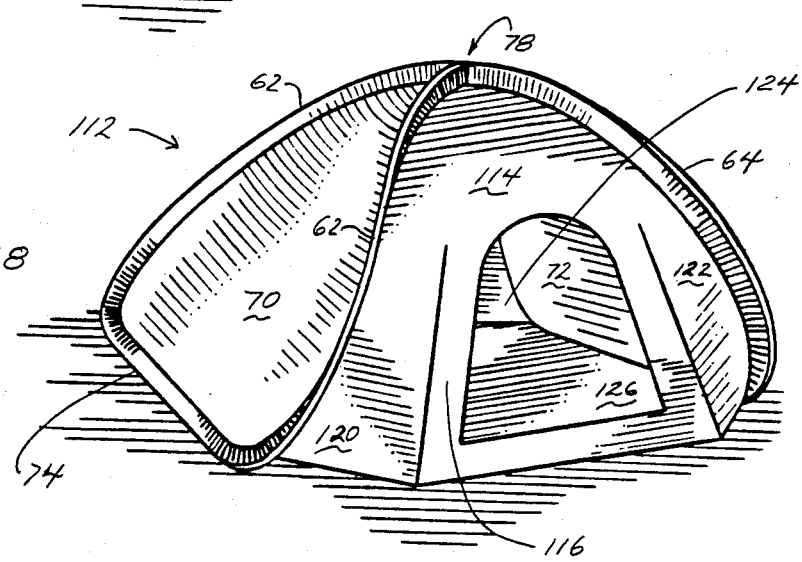
FIG. 18 is a perspective view depicting another embodiment of this invention in an expanded configuration with a full front panel having an extendible shape with door-like opening, the rear panel being identical but without the door-like opening.

FIG. 18 depicts still another embodiment of this invention with general structure 112 having extendible full front panel 114 with trapezoidal front section 116 containing doorway 118 and transition sections 120 and 122 attached to side panels 70 and 72, respectively. Structure 112 also has a full rear panel 124, partially seen in FIG. 18 through doorway 118 which is identical in shape to front panel 114 except without a doorway. Structure 112 also has floor panel 126 which is attached to the side, front and rear panels.

Figure 21:
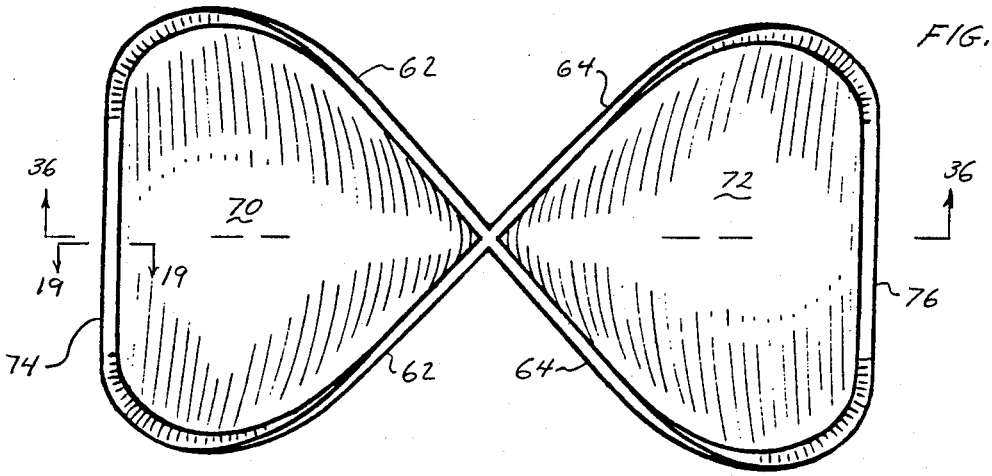
FIG. 21 is a top plan view of the structure of FIG. 2.
Figure 24:
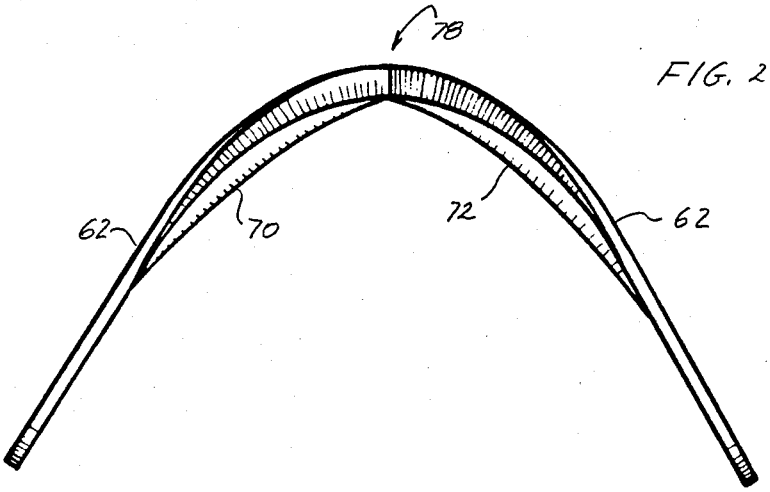
FIG. 24 is a front elevational view of the structure of FIG. 2, the rear elevational view being the mirror image of this figure.
Figure 27:
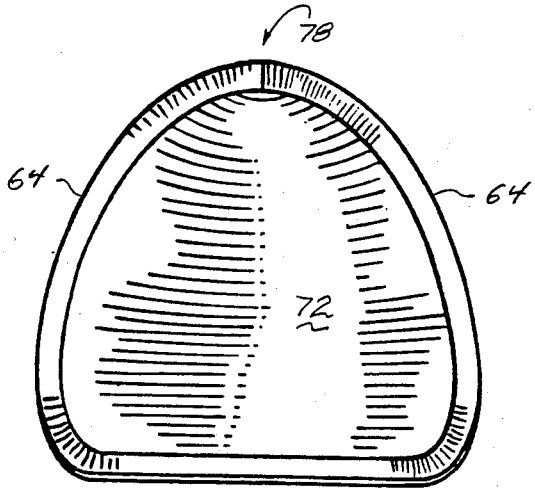
FIG. 27 is a right side elevational view of the structure of FIG. 2, the left side elevational view being identical in shape but with corresponding left side element members.

FIGS. 21, 24 and 27 are top plan, front elevational, and side elevational views, respectively, of structure 60 shown with an average spreading apart of straight portions 74 and 76.

Figure 22:
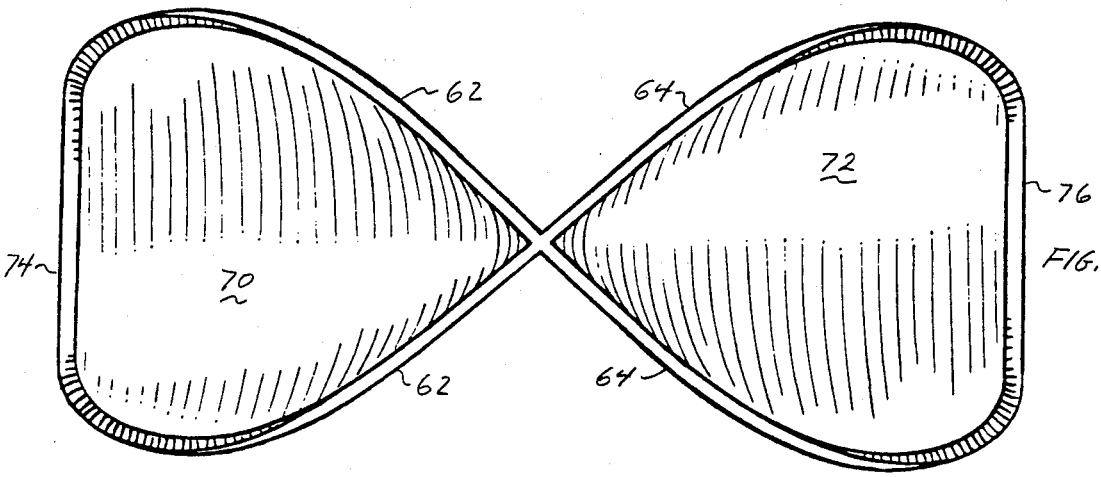
FIG. 22 is a top plan view of the structure of FIG. 3.
Figure 25:
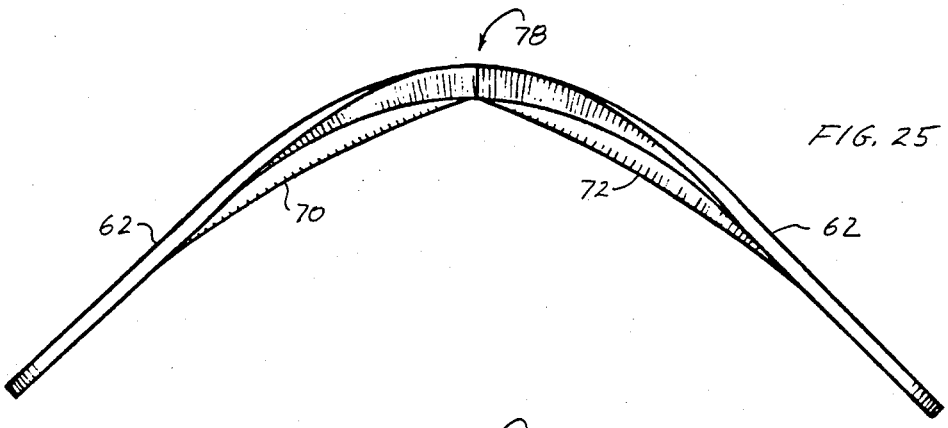
FIG. 25 is a front elevational view of the structure of FIG. 3, the rear elevational view being the mirror image of this figure.
Figure 28:
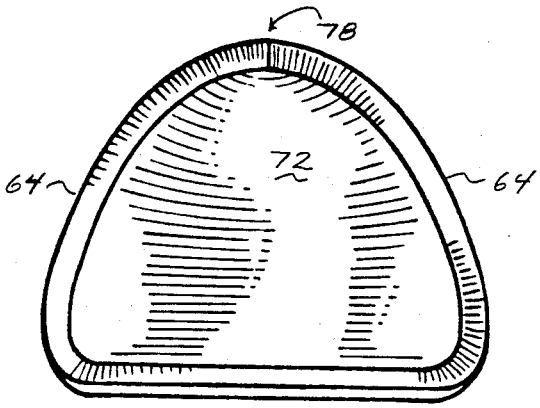
FIG. 28 is a right side elevational view of the structure of FIG. 3, the left side elevational view being identical in shape but with corresponding left side element members.

FIGS. 22, 25 and 28 and top plan, front elevational, and side elevational views, respectively, of structure 60 shown with a wide spreading apart of straight portions 74 and 76.

Figure 23:
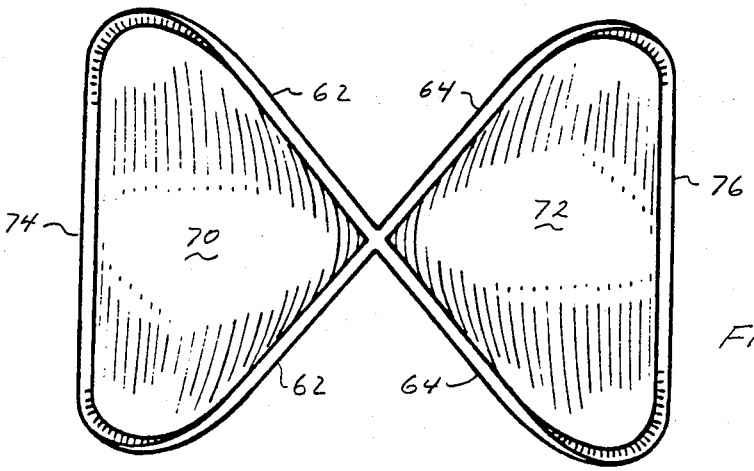
FIG. 23 is a top plan view of the structure of FIG. 4.
Figure 26:
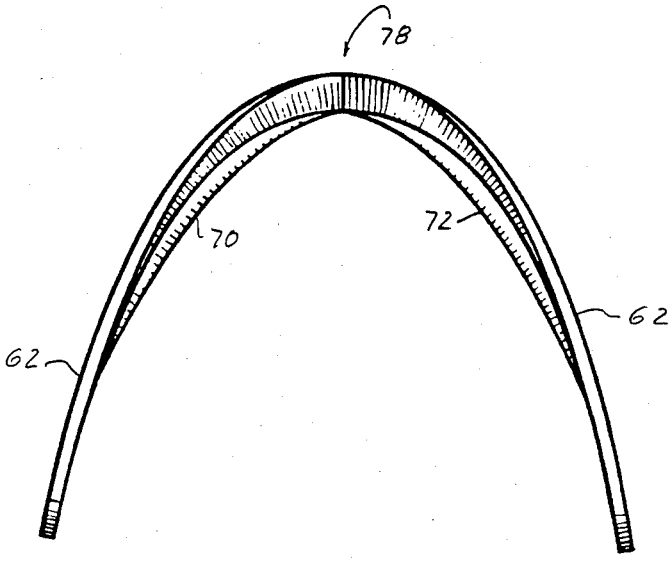
FIG. 26 is a front elevational view of the structure of FIG. 4, the rear elevational view being the mirror image of this figure.
Figure 29:
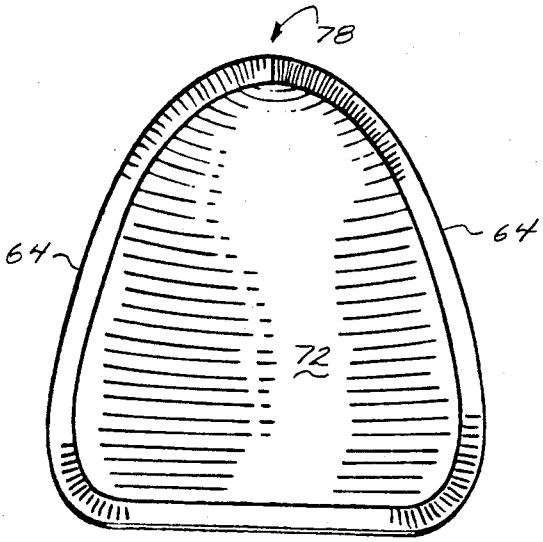
FIG. 29 is a right side elevational view of the structure of FIG. 4, the left side elevational view being identical in shape but with corresponding left side element members.

FIGS. 23, 26 and 29 are top plan, front elevational, and side elevational views, respectively, of structure 60 with a narrow spreading apart of straight portions 74 and 76.

Figure 33:
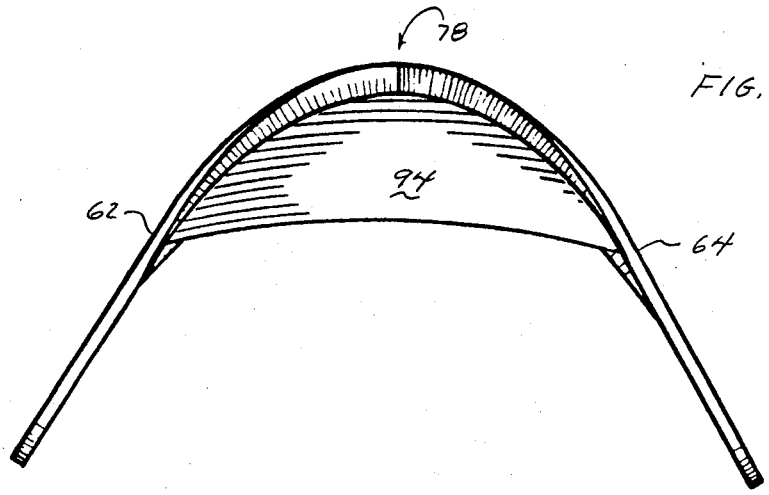
FIG. 33 is a front elevational view of the structure of FIG. 12, the rear elevational view being identical in shape but with corresponding responding rear element numbers.

FIGS. 30 and 33 are top plan, and front elevational views, respectively, of structure 92 shown with an average spreading apart of straight portions 74 and 76; the side elevational view thereof being identical to FIG. 27.

Figure 34:
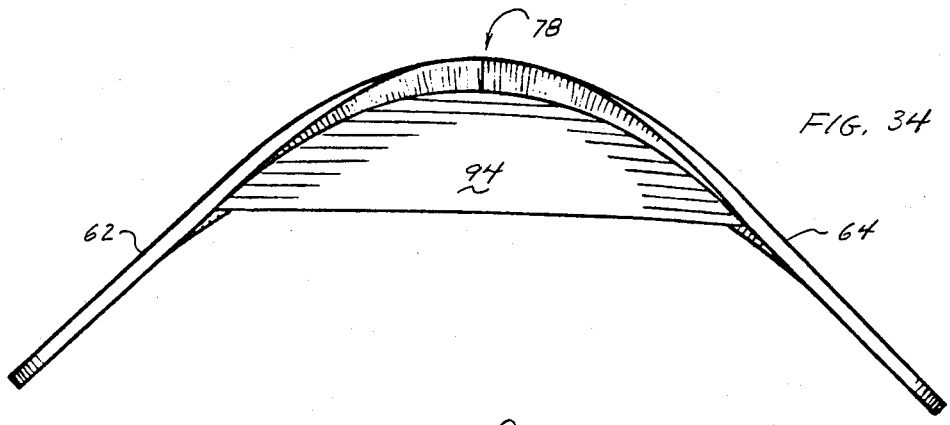
FIG. 34 is a front elevational view of the structure of FIG. 13, the rear elevational view being identical in shape but with corresponding rear element numbers.

FIGS. 31 and 34 are top plan, and front elevational views, respectively, of structure 92 shown with a wide spreading apart of straight portions 74 and 76; the side elevational view thereof being identical to FIG. 28.

Figure 35:
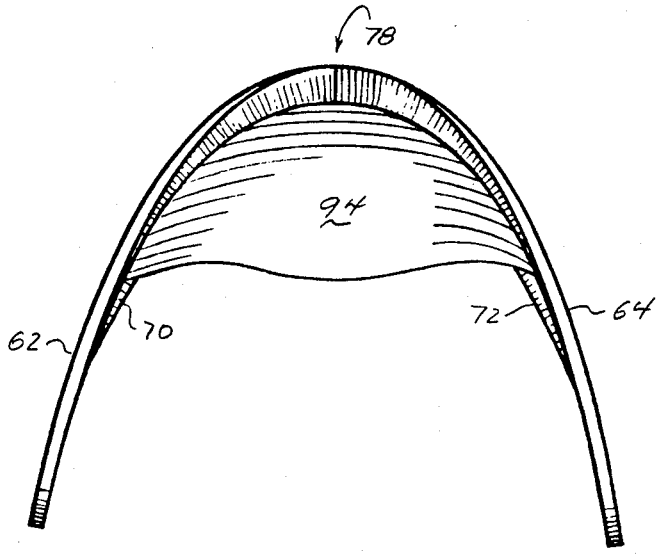
FIG. 35 is a front elevational view of the structure of FIG. 14, the rear elevational view being identical in shape but with corresponding rear element numbers. The left and right side elevational-views of the structure of FIGS. 12, 13 and 14 are identical to FIGS. 27, 28 and 29, respectively.

FIGS. 32 and 35 are top plan, and front elevational views, respectively, of structure 92 shown with a narrow spreading apart of straight portions 74 and 76; the side elevational view thereof being identical to FIG. 29.

Figure 36:
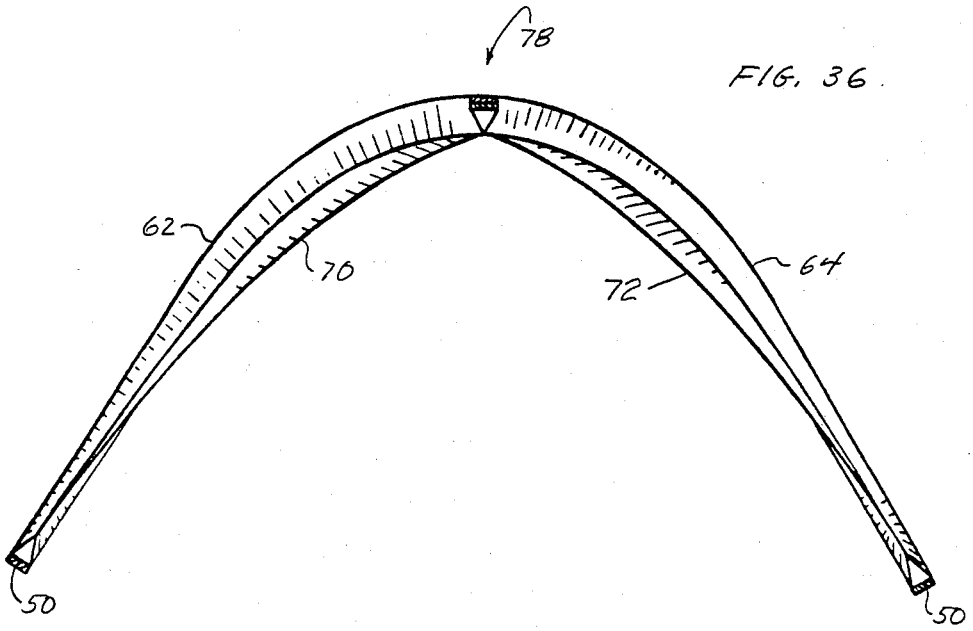
FIG. 36 is a front elevational view in cross section of the structure of FIG. 21 taken through line 36—36.

FIG. 36 is an elevational view in cross section of structure 60 taken through line 36—36 of FIG. 21 with straight portions 74 and 76 spread an average distance apart as shown in FIGS. 2 and 24.

Figure 37:
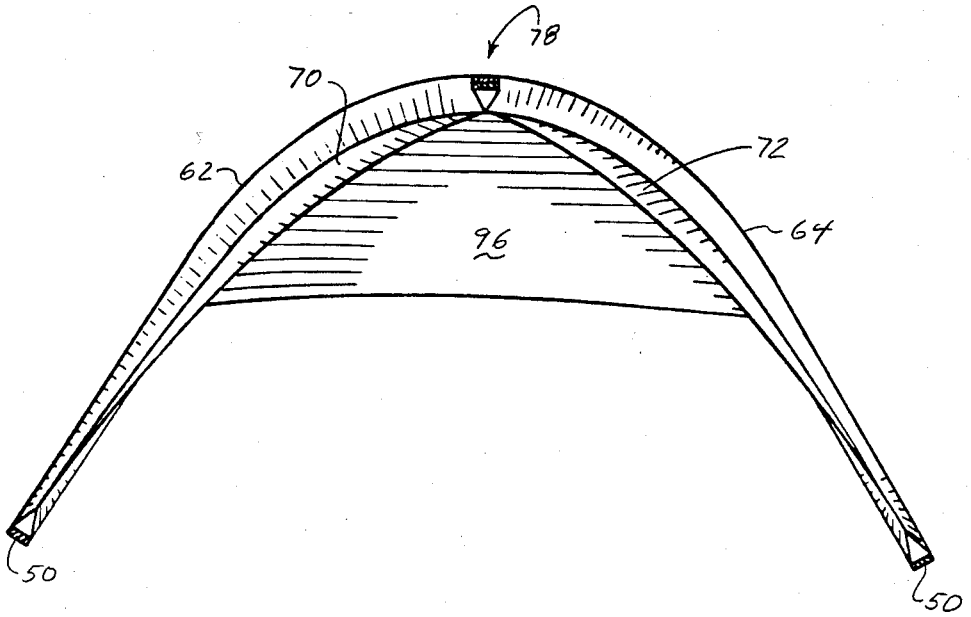
FIG. 37 is a front elevational view in cross section of the structure of FIG. 30 taken through line 37—37.

FIG. 37 is an elevational view in cross section of structure 92 taken through line 37—37 of FIG. 30 with straight portions 74 and 76 spread an average distance apart as shown in FIGS. 12 and 33.

Figure 38:
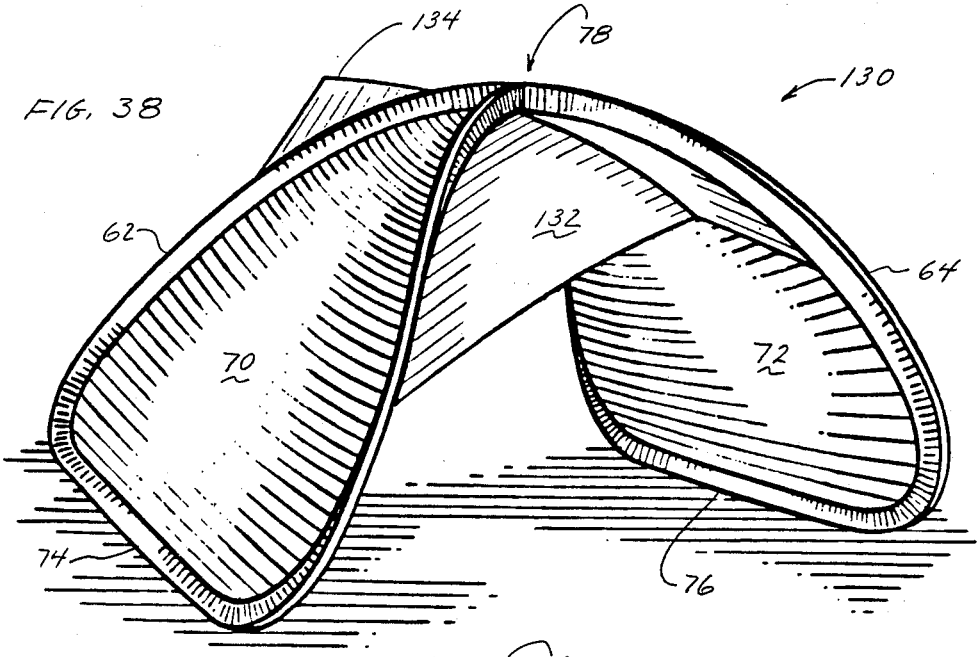
FIG. 38 is a perspective view of another embodiment of this invention with small pop out front and rear panels for additional shade from sunlight.
Figure 39:
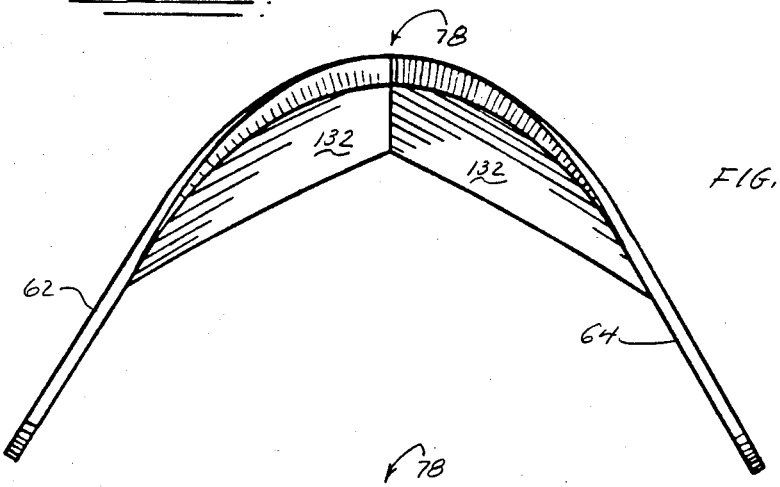
FIG. 39 is a front elevational view of the structure of FIG. 38, the rear elevational view being identical in shape but with corresponding rear element numbers.
Figure 40:
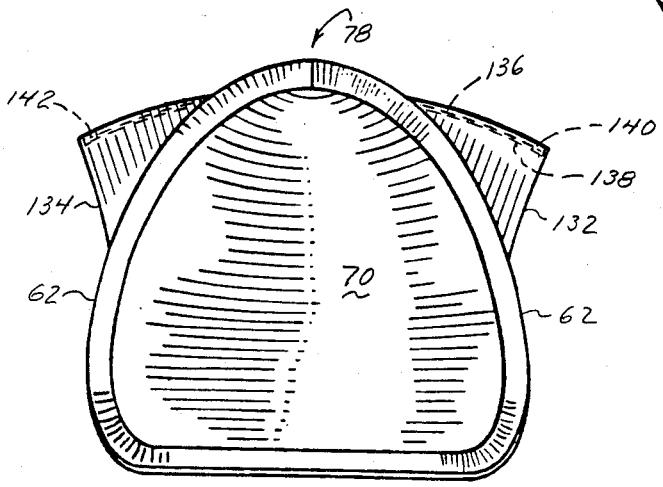
FIG. 40 is a left side elevational view of the structure of FIG. 38, the right side elevational view being identical in shape but with corresponding right side element numbers.

FIG. 38 depicts yet another embodiment of this invention with general structure 130 having small front and rear pop-out panels or hoods 132 and 134, respectively, for providing for additional shading under the structure. FIGS. 39, 40 and 41 are front elevational, right side elevational and top plan views of structure 130. Hood panels 132 and 134 can be held taut by small flexible stiffening stay or bone 136 slid into sleeve 138 of the hood after structure 130 is in its expanded configuration. Sleeve 138 has small pockets 140 and 142 design to hold the end of stay 136 in sleeve 138.

In embodiments of this invention which are constructed of particularly light weight materials so that they can be used for beach cabanas for shading, a further embodiment contains side panel pockets located near straight portions 74 and 76 for filling with a small amount of sand so as to prevent the structure from being pushed along the beach by wind. FIG. 42 shows small side pocket 150 which can be added to any of the embodiments of this invention for filling with sand to prevent wind from displacing the structure.

FIG. 43 depicts yet another embodiment of this invention with general structure 160 adapted to fit over a spa as protection from wind or sun or to help retain the temperature of the spa water and reduce the heat load. In this embodiment, side, front and rear panels are connected to small skirt 162 which extends around the lower periphery of structure 160. The skirt can contain eyelets 164 designed to fit over fasteners on spa 166.

The attachment of elongated pockets 62 and 64 of structures 60, 92, 102, 112, 130 and 160 to the various panels is shown in cross-sectional detail in FIGS. 19 and 20. In particular, FIG. 19 shows elongated pocket 62 (or 64) containing frame 50 sewn to side panel 70 (or 72). FIG. 20 shows pocket 62 (or 64) containing frame 50 sewn to side panel 70 (or 72) and front panel 94. Instead of front panel 94, the pocket could be sewn to any of the front, rear, floor, or hood panels such as panels 96, 100, 104, 114, 124, 126, 132 and 134 or skirt 162. Furthermore, it is not necessary to use the particular elongated pocket shown in the figures to house the frame and any sleeve design desired can be used to contain the frame.

However, it is preferred that the frame be free to slide in the sleeve so that the panel material is not stressed during transformation of the structure from the expanded to the collapsed configuration and visa versa.

It has also been found that it is not necessary to pin the overlying frame parts together at the crossover point and in fact less strain is put on the panel material when the frame is not pinned together at the crossover point thereby allowing the frame parts to slide relative to each other as well as relative to respective their pocket.

Referring now to FIG. 44, depicted there is the crossover point 78 of the frame member 50 enclosed within elongated pockets 62 and 64 at the apex of the structure 92. Proximate crossover point 78 the materials of the pockets are joined together at four seam lines 170 extending between crossover point 78 and the junction between the elongated pockets and panels 70, 72, 94, and 96 which is referred to as roofline 172. Because of the tension in elongated pockets 62 and 64 developed by the compression of frame member 50, seam lines 170, particularly proximate crossover point 78, tend to be highly concentrated tensional stress regions. Further, because of the small dimensions and intricate folding of the material of elongated pockets 62 and 64 about crossover point 78, it is difficult during manufacturing to ensure that the fabric of the elongated pockets is always properly secured together. To prevent the elongated pockets from rupturing along seam lines 170, the ends of the elongated pocket materials are preferably prepared with a "V" shaped end, 174, as depicted in FIG. 45. Seam lines 170, which are depicted by dashed lines in FIG. 45, are formed parallel to edges 176 of the elongated pocket material. Thus when the elongated pockets are assembled by securing the material together along the seam lines 170, excess material is provided in the area proximate crossover point 78. This excess material about the crossover point causes the tension in the elongated pockets to be directed toward rooflines 172 rather than being concentrated at seam lines 170. By employing more sharply pointed ends 174, the excess material of the elongated pockets about the crossover point can be further increased and thus the tension in the elongated pockets can be increasingly directed away from the seam lines 170 to the rooflines 172. The actual angular value for "V" shaped ends 174 will vary depending upon the precise size and shape of the portable structure. However, an included angle of approximately 120° between seam lines 170, as shown in FIG. 45, is generally appropriate for a wide range of sizes and shapes for the portable structure of this invention.

Methods of forming the basic figure eight structure of this invention from a strip of spring steel are shown in FIGS. 46 to 48. FIG. 46 depicts the two ends of a length of frame material joined together to form frame 50 by riveting. Holes 180 are formed through frame 50 near both its ends and rivets 182 are then fastened through holes 180 to secure the two ends together. However, because of the tension which exists in the structure, fastening the ends of the frame together by riveting when the material is almost completely enclosed within the elongated pockets is an awkward task. A more facile method of fastening the ends together is by swaged clamping as depicted in FIG. 47. To fasten the ends together by swaged clamping, the ends are merely lapped over each other while clamps 183 are swaged around the overlapped frame with a swaging tool (not shown). FIG. 48 depicts still another method for joining the ends of the frame together in which the ends are secured by molded clamp 184. Molded clamp 184 further includes means for preventing accidental withdrawal of the ends of frame 50 from clamp 184 such as pins 186 which are secured to clamp 184 through apertures 188 formed near the ends of the frame.

All of the structures illustrated can be quickly transformed between the expanded and collapsed configurations in the manner shown in FIGS. 5 to 11 for structure 60. None of the structures illustrated require frame 50 to be separated either partly or entirely from the side, or from the front, rear or floor panels if the latter are included in the structure, in order for the structure to be transformed between its configurations. Further, all of the structures are stable and will not roll over when placed on a flat surface because of straight portions 74 and 76 of the structures. While straight portions 74 and 76 are straight in the expanded configuration, the frame is constructed from a flexible coilable material which enables the frame and structure to be transformed quickly into its collapsed configuration of six coiled rings superimposed on each other. Therefore straight portions 55 and 56 of frame 50 bend in the collapsed configuration while nonetheless remaining straight when the portable structure is in the expanded configuration so as to impart the necessary stability to the expanded configuration. Furthermore, the portable structures of this invention become instantly stable the second they are transformed to the expanded configuration and do not require staking to become stable. Except for hooded structure 130 in which a single stay or bone is removed, none of the illustrated embodiments have any components removed or separated from the frame or panel materials at any time thereby enabling the various structures to be readily expanded and collapsed by a user not particularly skilled in mechanical arts or even a child.

Furthermore, the ability to fabricate the structures of this invention from light weight materials make this invention very portable. Such light weight structures are particularly useful as beach cabanas and the like and are much lighter than the typical beach umbrella, easier to put up and take down, and do not have the disadvantage a tending to frequently fall over as with beach umbrellas. Furthermore, no deep hole will have to be dug in the sand for the pole as in the case of beach umbrellas. Several embodiments of this invention provide more shade than the typical beach umbrella and can be easily moved from one position to another as the sun moves, or made wider or narrower as desired by the user.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in the figures and that variations in such minor details will be apparent to one skilled in the art.

Therefore it is to be understood that the present disclosure and embodiment of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

INDUSTRIAL APPLICABILITY

The portable structures of this invention are useful as beach cabana, sun shelters, spa enclosures and tents.

What is claimed is:

1. A portable structure operable for transforming from a collapsible configuration into an expanded configuration and thence back into said collapsible configuration comprising:

a frame formed from a flexible coilable material, said frame having, when in an expanded configuration, a shape of a figure eight thereby defining first and second loops and a crossover with said crossover forming an apex of said structure and the loops thereof extending downwardly therefrom; and first and second side panels formed from a foldable cloth-like material, said first and second side panels spanning said first and second loops, respectively, of said frame and connected thereto, said first and second side panels each having a straight portion opposite said crossover, said straight portion of said panels being operative for forming when said portable structure is in said expanded configuration a corresponding stable straight portion in each of said loops of said frame opposite said crossover, said corresponding stable straight portion of said loops being operable, when said structure is in said expanded configuration with said straight portion of said loops placed on top of a flat surface, for preventing said structure from rolling over and for maintaining said crossover at the apex of said structure, said structure, when in said expanded configuration, being operable for transforming by collapsing into a collapsible configuration without separation of said frame from said side panels, said collapsible configuration comprising six overlying loops of said frame, said structure, when in said collapsible configuration, being operable for transforming into said expandable configuration without separation of said frame from said side panels merely by spreading such six overlying loops of said frame apart and allowing said frame to spring into said expanded configuration.

2. The portable structure of claim 1, wherein said frame is a continuous piece of said flexible coilable material.

3. The portable structure of claim 1, wherein said straight portion of at least one of said loops is between about 10 and about 40% of the periphery of said loop.

4. The portable structure of claim 1, wherein said straight portion of at least one of said loops is between about 20 and about 30% of the periphery of said loop.

5. The portable structure of claim 1, wherein said flexible coilable material of said frame has a predetermined amount of original curvature operable for effecting a predetermined height for said structure when in said expanded configuration with said straight portions of said loops placed on top of a flat surface, said predetermined height being defined as the vertical distance from said flat surface to said crossover of said structure.

6. The portable structure of claim 1, wherein said flexible coilable material of said frame has a cross section having a width and a thickness and wherein said width is at least about two times larger than said thickness.

7. The portable structure of claim 1, wherein said flexible coilable material of said frame contains one 360° twist.

8. The portable structure of claim 1, wherein said flexible coilable material of said frame has an upper surface and a lower surface which define a maximum thickness therebetween and a first side surface and a second side surface which define a maximum width therebetween, wherein said maximum width thereof is at least about two times larger than said maximum thickness thereof, wherein said flexible coilable material of said frame contains one 360° twist, wherein at said crossover there is an upper portion of said frame on top of a lower portion of said frame and wherein said lower surface of said upper portion of said frame lays over top and faces said upper surface of said lower portion of said frame.

9. The portable structure of claim 1, wherein said first and second side panels are connected to said first and second loops, respectively, of said frame by first and second elongated pockets, respectively, wherein said first and second elongated pockets, respectively, wherein said first and second elongated pockets are permanently attached to said first and second side panels, respectively, wherein said first and second loops of said frame are slideably enclosed in said first and second elongated pockets, respectively, and wherein when said portable structure is in said expanded configuration, said elongated pockets extend upwardly and outwardly from said side panels at said crossover.

10. The portable structure of claim 1, further comprising a floor panel formed from a foldable cloth-like material, said floor panel spanning between said straight portion of said first loop and said straight portion of said second loop.

11. The portable structure of claim 1, further comprising front and rear panels formed from a foldable cloth-like material, said front and rear panels spanning at least a portion of front and rear spaces, respectively, between said side panels, said front and rear panels being connected to front and rear parts, respectively, of said side panels.

12. The portable structure of claim 11, wherein said front and rear panels are connected to said side panels proximate said crossover and extend downwardly therefrom and proximate said frame a distance of at least about ¼ of a distance between said crossover of said frame and an horizontally projected extension, respectively, of said straight portion of said frame.

13. The portable structure of claim 12, wherein said rear panel extends downwardly from said crossover a greater distance than said front panel extends downwardly from said crossover.

14. The portable structure of claim 11, wherein said front and rear panels are connected to said side panels proximate said crossover of said frame and extend downwardly therefrom, when said structure is in its expanded configuration, to said straight portion of said loops, and wherein said front panel comprises an opening.

15. The portable structure of claim 14, wherein said front and rear panels each have a bottom edge, and further comprising a floor panel formed from a foldable cloth-like material, said floor panel spanning between said straight portion of said first loop and said straight portion of said second loop, and said floor panel being connected to said bottom edge of said front and rear panels.

16. The portable structure of claim 11, wherein said front and rear panels each have a lower edge, and further comprising a tension means for tensioning said lower edge of said front panel from said lower edge of said rear panel.

17. The portable structure of claim 1, further comprising side pockets attached to the outside surface of each of said side panels, respectively, proximate said straight portion of said loops, each of said side pockets having an upwardly facing pocket opening when said structure is in said expanded configuration with said straight portion of said loops placed on top of a flat surface.

18. A portable structure operable for transforming from a collapsible configuration into an expanded configuration and thence back into said collapsible configuration comprising;

a frame formed from a flexible coilable material, said frame having, when in an expanded configuration, a shape of a figure eight thereby defining first and second loops and a crossover with said crossover forming an apex of said structure and the loops thereof extending downwardly therefrom, wherein said frame is a continuous piece of said flexible coilable material and contains one 360° twist, and wherein said flexible coilable material of said frame has a cross section having a width and a thickness and wherein said width is at least about two times larger than said thickness; and first and second side panels formed from a foldable cloth-like material, said first and second side panels spanning said first and second loops, respectively, of said frame and connected thereto, said first and second side panels each having a straight portion opposite said crossover, said straight portion of said panels being operative for forming when said portable structure is in said expanded configuration a corresponding stable straight portion in each of said loops of said frame opposite said crossover, wherein said straight portion of each of said loops is between about 10 and about 40% of the periphery of said loop, said corresponding stable straight portion of said loops being operable, when said structure is in said expanded configuration with said straight portion of said loops placed on top of a flat surface, for preventing said structure from rolling over and for maintaining said crossover at the apex of said structure, said structure, when in said expanded configuration, being operable for transforming by collapsing into a collapsible configuration without separation of said frame from said side panels, said collapsible configuration comprising six overlying loops of said frame, said structure, when in said collapsible configuration, being operable for transforming into said expandable configuration without separation of said frame from said side panels merely by spreading such six overlying loops of said frame apart and allowing said frame to spring into said expanded configuration.

19. A portable structure operable for transforming from a collapsible configuration into an expanded configuration and thence back into said collapsible configuration comprising;

a frame formed from a flexible coilable material, said frame having, when in an expanded configuration, a shape of a figure eight thereby defining first and second loops and a crossover with said crossover forming an apex of said structure and the loops thereof extending downwardly therefrom, wherein said frame is a continuous piece of said flexible coilable material and contains one 360° twist, and wherein said flexible coilable material of said frame has a cross section having a width and a thickness and wherein said width is at least about two times larger than said thickness; and first and second side panels formed from a foldable cloth-like material, said first and second side panels spanning said first and second loops, respectively, of said frame and connected thereto, said first and second side panels each having a straight portion opposite said crossover, said straight portion of said panels being operative for forming when said portable structure is in said expanded configuration a corresponding stable straight portion in each of said loops of said frame opposite said crossover, wherein said straight portion of each of said loops is between about 10 and about 40% of the periphery of said loop, wherein said first and second side panels are connected to said first and second loops, respectively, of said frame by first and second elongated pockets, respectively, wherein said first and second elongated pockets are attached to said first and second side panels, respectively, wherein said first and second loops of said frame are slideably enclosed in said first and second elongated pockets, respectively, and wherein when said portable structure is in said expanded configuration, said elongated pockets extend upwardly and outwardly from said side panels at said crossover, said corresponding stable straight portion of said loops being operable, when said structure is in said expanded configuration with said straight portion of said loops placed on top of a flat surface, for preventing said structure from rolling over and for maintaining said crossover at the apex of said structure, said structure, when in said expanded configuration, being operable for transforming by collapsing into a collapsible configuration without separation of said frame from said side panels, said collapsible configuration comprising six overlying loops of said frame, said structure, when in said collapsible configuration, being operable for transforming into said expandable configuration without separation of said frame from said side panels merely by spreading such six overlying loops of said frame apart and allowing said frame to spring into said expanded configuration.

20. The portable structure of claim 19, further comprising front and rear panels formed from a foldable cloth-like material, said front and rear panels being connected to front and rear parts, respectively, of said elongated pockets, wherein said front and rear panels are connected to said elongated pockets proximate said crossover and extend downwardly therefrom and proximate said frame a distance of at least about ¼ of a distance between said crossover of said frame and an horizontally projected extension, respectively, of said straight portion of said frame.

* * * * *